United States Patent [19]

Shah et al.

[11] 4,453,947

[45] Jun. 12, 1984

[54] LOW VISCOSITY STABLE MIXTURES OF COAL AND FUEL OIL CONTAINING ALCOHOL

[75] Inventors: Dinesh O. Shah; K. C. Adiga, both of Gainesville, Fla.; A. N. SunderRam, Richton Park, Ill.

[73] Assignee: University of Florida, Gainesville, Fla.

[21] Appl. No.: 359,372

[22] Filed: Mar. 18, 1982

[51] Int. Cl.[3] ..... C10L 1/32

[52] U.S. Cl. ..... 44/51; 44/53; 44/56; 585/14

[58] Field of Search ..... 44/51, 53, 56; 585/14

[56] References Cited

U.S. PATENT DOCUMENTS

| | | | |
|---|---|---|---|
| 1,471,566 | 10/1923 | Murphy | 44/56 |
| 3,210,168 | 10/1965 | Morway | 44/51 |
| 3,458,294 | 7/1969 | Nixon et al. | 44/51 |
| 3,917,537 | 11/1975 | Elsdon | 44/53 X |
| 4,130,401 | 12/1978 | Meyer et al. | 44/51 |
| 4,177,039 | 12/1979 | Sakuma et al. | 44/53 X |
| 4,243,493 | 1/1981 | Gruber et al. | 44/56 |

FOREIGN PATENT DOCUMENTS

| | | | |
|---|---|---|---|
| 2011983 | 3/1970 | France | 44/77 |

OTHER PUBLICATIONS

*McCutcheon's Detergents & Emulsifiers,* 1973 N. American Edition, McCutcheon's Division, Allured Publishing Corp.: Ridgewood, N.J. 07450, pp. 154, 182.

*Primary Examiner*—Charles F. Warren
*Assistant Examiner*—Margaret B. Medley
*Attorney, Agent, or Firm*—Arthur G. Yeager

[57] ABSTRACT

A stable homogeneous liquid fuel composition comprising a petroleum residual oil having a viscosity at room temperature of 1–2.5 poises, an alcohol of 1–2 carbon atoms, and a hydrocarbon coupling agent. This composition has utility as a fuel per se and as a liquid carrier in which powdered coal can be dispered to produce another liquid fuel.

15 Claims, 1 Drawing Figure

LOW VISCOSITY STABLE MIXTURES OF COAL AND FUEL OIL CONTAINING ALCOHOL

BACKGROUND OF THE INVENTION

In the past several years petroleum crude oil has increased in price many-fold due to the controls in production and price levels established by the Middle East countries producing a large percentage of the world's crude oil. This has caused a significant increase in research efforts to develop alternative fuels. Among the areas investigated has been that of pulverizing coal and dispersing it in petroleum oil as an "extender" for the oil. Petroleum residual oil, as distinguished from "distillate" from which gasoline is produced, is of relatively high viscosity, e.g. 1–10 poises, and when powdered coal is added the viscosity rises rapidly with increasing concentrations of coal. At viscosities above about 5–10 poises, the liquid is too difficult to pump to consider the liquid as a practical fuel. Accordingly, it has been a difficult problem to produce easily pumpable coal in oil slurries at high coal concentrations (e.g. 50% to 60% by wt. of coal).

It is an object of this invention to provide a liquid fuel oil having the property of low viscosity. It is another object of this invention to provide a liquid fuel oil that is capable of carrying high concentrations of pulverized coal at low viscosities. Still other objects will appear from the more detailed description which follows.

BRIEF SUMMARY OF THE INVENTION

This invention provides a stable, homogeneous liquid fuel blend having a viscosity at room temperature of less than 0.6 poise comprising petroleum residual oil having a viscosity of 1.0 to 2.5 poises at room temperature, an alcohol of 1–2 carbon atoms, and as a coupling agent an aliphatic hydrocarbon liquid of 6–16 carbon atoms, preferably kerosene. In a preferred embodiment the invention provides a stable homogeneous liquid fuel comprising 65–90% by weight of a petroleum residual oil having a viscosity at room temperature of 1.0–2.5 poises, 5–25% by weight of an alcohol of 1–2 carbon atoms, and 5–15% by weight of a coupling agent selected from the group consisting of kerosene, n-alkane of 6–10 carbon atoms, and mixtures thereof.

This invention also provides a heating fuel composition comprising the above liquid fuel with pulverized coal dispersed therein, the dispersion containing 10–60% by weight of coal and the remaining 90–40% by weight of one of the above liquid fuels. Preferably the coal comprises 20–40% by weight of the composition with the liquid fuel comprising the remaining 60–80%.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DETAILED DESCRIPTION OF THE INVENTION

This invention contemplates both a basic liquid fuel and a heating fuel composition wherein that liquid fuel has pulverized coal dispersed therein.

The basic liquid fuel has three components which are mixed in proportions which will produce a homogeneous liquid i.e. a single-phase liquid in which the components are miscible and do not separate into more than one liquid layer over a reasonable period of time, e.g. 24 hours. The components are (1) a petroleum residual oil, (2) an alcohol of 1–2 carbon atoms, and (3) a coupling agent. The first two components are not miscible with each other when used alone, but in the presence of the third component, there is a significant range of component concentrations which result in a single-phase, homogeneous liquid. This is shown graphically in FIG. 1 which is a ternary diagram of these three components wherein the alcohol is ethanol and the coupling agent is either kerosene or n-hexane. In general, this shows that in the presence of the coupling agent, ethanol in concentrations up to about 25% by weight, is miscible in Fuel Oil No. 6.

The principal component of the basic liquid fuel is a petroleum residual oil. The term "residual oil" is intended to mean a fuel oil remaining after removing the light oils and distillate fractions from a crude petroleum. This "residual oil" will generally have a flash point above about 200° F. and a viscosity of at least about 0.5 to 2 poises at 100° F. Typical of these residual oils are Fuel Oil Nos. 4,5 and 6. The preferred of these oils for this invention is Fuel Oil No. 6.

The second component is an alcohol of 1–2 carbon atoms, which includes methanol and ethanol, the latter being preferred. For some reason which has not yet become clear, denatured ethanol appears to function slightly better than absolute ethanol in the composition of this invention.

The third component is a coupling agent which is believed to provide some type of bonding between the residual oil and the alcohol to make them compatible and miscible. The coupling agent is an aliphatic hydrocarbon of 6–16 carbon atoms, including materials such as kerosene, n-hexane, hexene, heptane, octane, octene, nonane, decane, decene, dodecane, tetradecane, tetradecene, hexadecane, or their mixtures. The preferred agents are kerosene, n-hexane, and mixtures of these two.

Figure 1:
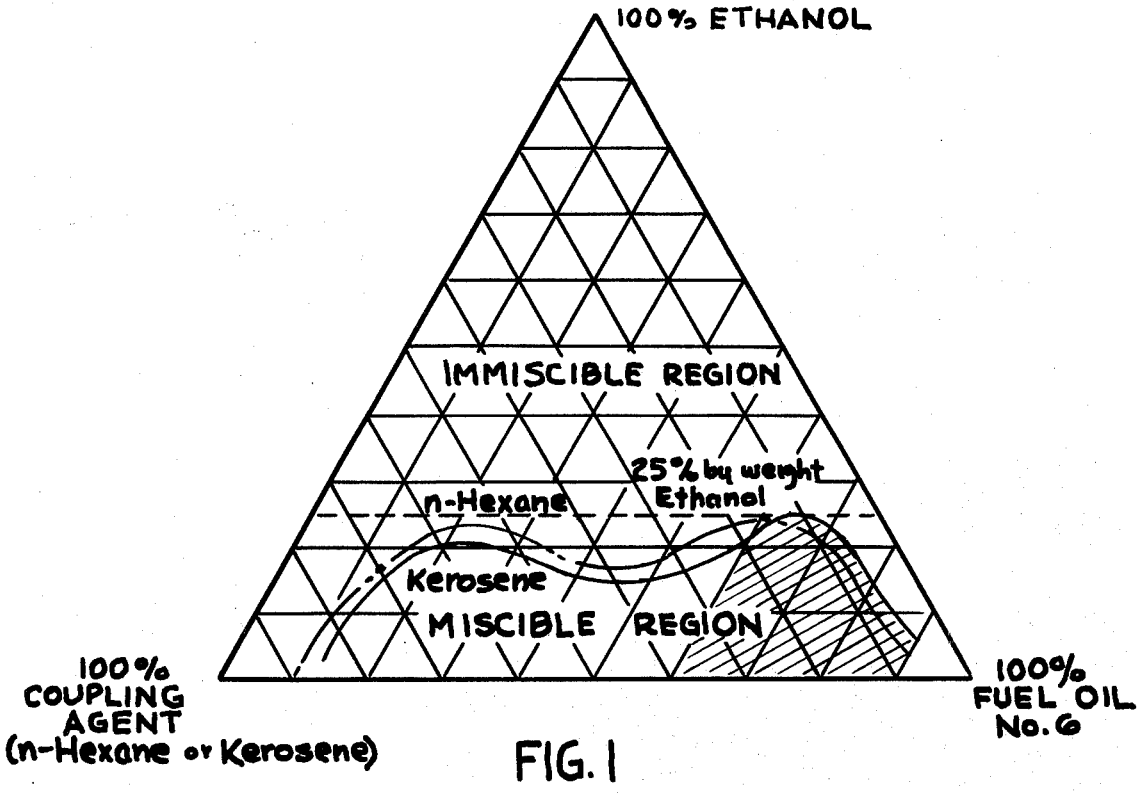
FIG. 1 is a ternary diagram of compositions containing Fuel Oil No. 6, ethanol, and a coupling agent, the diagram including the area wherein the three components are miscible and produce a homogeneous composition.

When these components are mixed in the proportions that fall within the "miscible region" of FIG. 1, i.e. between the bottom line of the graph and the curved lines labelled "n-Hexane" or "Kerosene", the resulting mixture is a single-phase liquid having a viscosity considerably lower than that of the fuel oil by itself. As stated above, this generally is a composition of about 25% or less ethanol. The ranges of fuel oil and coupling agent may vary widely so long as the ethanol is 25% or less by weight of the total. However, the most useful compositions as a fuel are those of high fuel oil content, which means those in shaded portion in the lower right hand corner of the graph. Several compositions that illustrate these statements are listed below in Table 1. In each instance the total volume of the composition is 100 parts by volume. The data show that the viscosity of the miscible composition is many times lower than the viscosity of the unmodified fuel oil.

TABLE 1

| Blend Composition (% Weight) | | Ethanol-to- | Immiscible | |
|---|---|---|---|---|
| Fuel Oil | Ethanol + Kerosene | Kerosene Ratio | Volume (parts) | Viscosity (cp) |
| 65 | 35 | 10.6 | 2.0 | |
| | | 6.0 | 1.0 | |
| | | 2.5 | 0.5 | 30 |
| | | 1.33 | 0 | |
| 70 | 30 | 14.0 | 3.0 | |
| | | 5 | 1.0 | |
| | | 2.75 | 0.5 | 42 |
| | | 1.0 | 9 | |
| 75 | 25 | 4.0 | 1.0 | |
| | | 3.0 | 0.5 | 50 |
| | | 1.0 | 0 | |
| 100 | 0 | | 0 | 220 |

The above described liquid fuel compositions are excellent carriers for powdered coal. The low viscosity of the liquid fuel permits a high loading of pulverized coal to produce a pumpable blend of coal and fuel oil containing a higher percentage of coal than has heretofore been available. The coal that is used is crushed to a particle size such that at least 80% passes through 200 mesh and the remainder through 325 mesh. Any type of coal is suitable.

Figure 2:
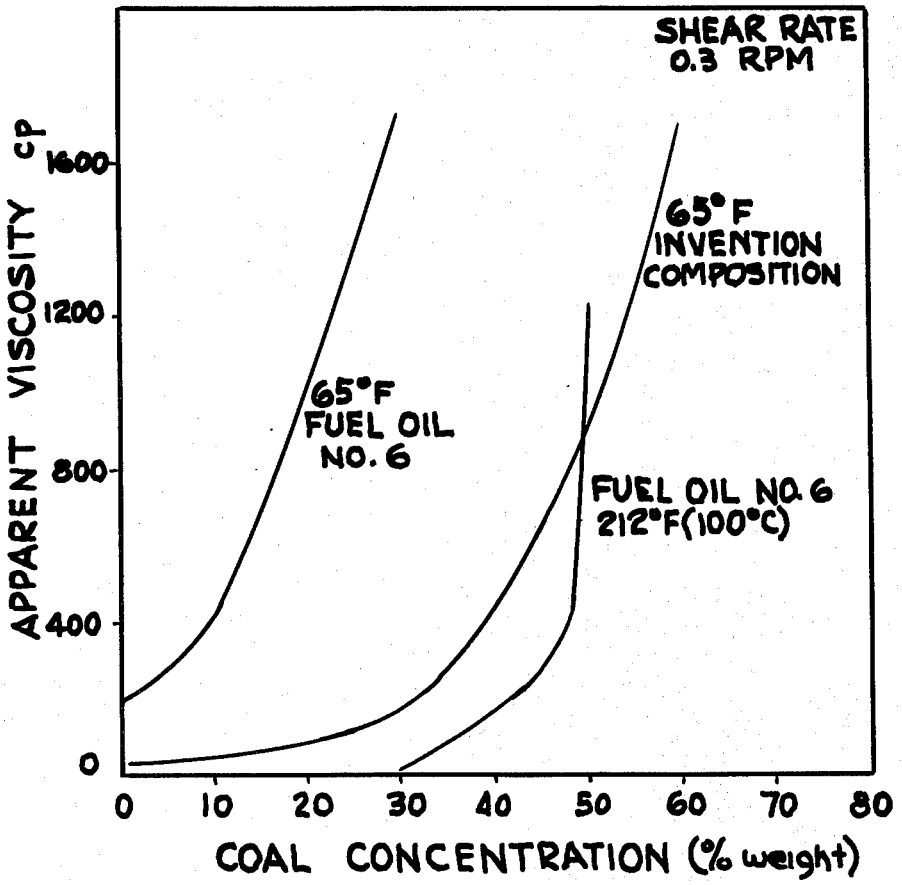
FIG. 2 is a graph showing how viscosity varies with coal concentration in Fuel Oil No. 6 at 65° F. and 212° F. as compared to the heating fuel compositions of this invention at 65° F.

In prior art procedures of blending fuel oil with powdered coal, it was found that the viscosity of the blend rose rapidly with increasing coal concentrations, and in order to retain a pumpable viscosity, it was necessary to heat the blend to an elevated temperature. By using the liquid fuel composition of this invention (fuel oil/ethanol/coupling agent) it has been possible to obtain blends with powdered coal that need not be heated to obtain the pumpable viscosity. This is illustrated in FIG. 2 which shows graphically the viscosity changes with increasing concentration of powdered coal in Fuel Oil No. 6 at 65° F. and 212° F. as compared to the liquid fuel of this invention using Fuel Oil No. 6 as the petroleum oil component. The shear rate in the viscosity measurement was kept constant at 0.3 rpm. At approximately 30% coal concentration in Fuel Oil No. 6 at 65° F. the viscosity is approximately 1700 cp., and if that mixture is heated to 212° F., the viscosity drops to approximately 50 cp. If the liquid fuel of this invention is used at 64° F., the viscosity can be kept within pumpable ranges even at high coal concentrations (50 to 60% of coal ). Therefore, the liquid fuel of this invention provides tremendous energy savings in eliminating the cost of heating the fuel oil to make it suitable for carrying more than 30% of coal.

It has also been found that the addition of a small amount of any of several surfactants lowers the viscosity of the coal/liquid fuel compositions of this invention. For example, the addition of 0.25% by weight of a surfactant to a coal/liquid fuel composition having a viscosity of about 170 cp. at 65° F. lowered the viscosity to 110–160 cp. using any of four different surfactants.

The stability of the coal/liquid fuel blend appears to be greatly enhanced by the presence of a surfactant. In a test with a blend containing 30% coal at 65° F., the blend was permitted to stand without stirring over long periods of time and measurements were made of phase separation and the loss of coal from the oily upper layer by settling into the lower layer. The same measurements were made with the coal/liquid fuel blend containing 0.25% by weight of a surfactant and the results showed improvement with each surfactant. The preferred surfactant (Triton X-15) provided the most stable blend with less than 5% loss in coal from the oily layer over a period of 150 hours.

The surfactants which have been found useful include; Span 20 (Sorbitan monolaurate, HLB 8.6), an anionic surfactant Triton X-15 (Alkyl phenoxy polyethoxy ethanol), Tergitol (nonionic surfactant) and TRS 10–80, a petroleum sulfonate of anionic type.

This invention includes liquid fuel compositions and coal/liquid fuel compositions. The liquid fuel contains 65–90% by weight of petroleum residual oil;

5–25% by weight of an alcohol of 1–2 carbom atoms; and

5–15% by weight of an aliphatic hydrocarbon coupling agent of 6–10 carbon atoms

Preferably, the liquid fuel contains:

65–75% Fuel Oil No. 6

10–25% ethanol; and

5–15% kerosene, n-hexane, or a mixture of the two.

When the above liquid fuel is blended with powdered coal the blend may contain 40–90% liquid fuel and 10–60% coal, with the preferred amounts being 60–80% liquid fuel and 20–40% coal. Preferably the blend also contains 0.1 to 0.5% by weight of a compatible surfactant.

The compositions of the present invention provide advantages in the conservation of petroleum oils and in general energy consumption. The low viscosity liquid fuel can be used for direct consumption in oil-fired utility and industrial boilers in place of the petroleum fuel oil now used. Ethanol is expected to become available from biomass conversion at a low cost. The liquid fuel will provide considerable savings in stretching the petroleum oil stocks available today. The coal/liquid fuel blends are also attractive boiler fuels. These blends provide even greater savings in petroleum oil stocks. They can be pumped or stored at ambient temperatures because of their low viscosity and stability.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A stable, homogeneous liquid fuel having a viscosity at room temperature of less than 0.6 poise comprising petroleum residual oil having a viscosity of 1.0 to 2.5 poises at room temperature, an alcohol of 1–2 carbon atoms, and as a coupling agent selected from the group consisting of kerosene and an aliphatic hydrocarbon of 6–16 carbon atoms.

2. A stable, homogeneous liquid fuel comprising 65–90% by weight of a petroleum residual oil having a viscosity at room temperature of 1.0–2.5 poises, 5–25% by weight of an alcohol of 1–2 carbon atoms, and 5–15% by weight of a coupling agent selected from the group consisting of kerosene, n-alkane of 6–10 carbon atoms, and mixtures thereof.

3. The fuel of claim 2 having a viscosity at room temperature of less than 0.6 poise.

4. The fuel of claim 2 wherein said coupling agent is a mixture of kerosene and n-hexane.

5. The fuel of claim 2 wherein said petroleum residual oil is Fuel Oil No. 6.

6. The fuel of claim 2 wherein said alcohol is ethanol.

7. The fuel of claim 6 wherein said ethanol is denatured.

8. The fuel of claim 2 which additionally comprises powdered coal.

9. A stable, pumpable dispersion of powdered coal in a liquid fuel comprising 10–60% by weight of powdered coal having a particle size not larger than about 200 mesh and the remaining 90–40% by weight of the liquid fuel of claim 2.

10. The dispersion of claim 9 additionally comprising 0.1–0.5% by weight of a surfactant.

11. The dispersion of claim 9 having a coal concentration of 20–30% and a viscosity at room temperature of less than 4.0 poise.

12. The dispersion of claim 9 wherein at least 80% of said coal has a particle size between 200 mesh and 325 mesh and the remaining 20% has a particle size of 325 mesh or smaller.

13. A stable dispersion of powdered coal in a liquid fuel wherein said dispersion has a viscosity at room temperature of less than about 8.0 poises, said dispersion comprising:

20–40% by weight of powdered coal having a particle size of not greater than 200 mesh;

80–60% by weight of a liquid fuel; and 0.1–0.5% by weight of a surfactant;

said liquid fuel comprising:

65–80% by weight of Fuel Oil No. 6

15–25% by weight of ethanol or methanol

5–15% by weight of kerosene or a mixture of kerosene and n-hexane

14. The dispersion of claim 13 wherein said liquid fuel contains 15–25% by weight of ethanol.

15. The dispersion of claim 13 wherein said liquid fuel contains 5–15% by weight of a mixture of kerosene and n-hexane with the weight proportions of kerosene to n-hexane being from 4:1 to 1:4.

* * * * *